US009683446B2

(12) United States Patent
Shaffer

(10) Patent No.: US 9,683,446 B2
(45) Date of Patent: Jun. 20, 2017

(54) GAS TURBINE ENGINE SHROUDED BLADE

(71) Applicant: Rolls-Royce Energy Systems Inc., Mount Vernon, OH (US)

(72) Inventor: Don L. Shaffer, Mount Vernon, OH (US)

(73) Assignee: Rolls-Royce Energy Systems, Inc., Mount Vernon, OH (US)

( * ) Notice: Subject to any disclaimer, the term of this patent is extended or adjusted under 35 U.S.C. 154(b) by 684 days.

(21) Appl. No.: 14/145,750

(22) Filed: Dec. 31, 2013

(65) Prior Publication Data

US 2015/0017003 A1 Jan. 15, 2015

Related U.S. Application Data

(60) Provisional application No. 61/774,138, filed on Mar. 7, 2013.

(51) Int. Cl.
*F01D 5/14* (2006.01)
*F01D 5/22* (2006.01)

(52) U.S. Cl.
CPC ..... *F01D 5/225* (2013.01); *F01D 5/147* (2013.01); *F05D 2230/60* (2013.01);
(Continued)

(58) Field of Classification Search
CPC ... F01D 5/14; F01D 5/147; F01D 5/20; F01D 5/22; F01D 5/225; F01D 5/26;
(Continued)

(56) References Cited

U.S. PATENT DOCUMENTS 3,377,050 A * 4/1968 Guy ..... F01D 5/225 416/191
3,576,377 A 4/1971 Beanland et al.
(Continued)

FOREIGN PATENT DOCUMENTS

DE WO 2005008032 A1 * 1/2005 ..... B22F 3/225
EP 2402559 A1 1/2012
(Continued)

OTHER PUBLICATIONS

International Search Report for PCT International Application Serial No. PCT/US2014/010052, completed Apr. 4, 2014, (12 pages).
(Continued)

*Primary Examiner* — Gregory Anderson
*Assistant Examiner* — Christopher R Legendre
(74) *Attorney, Agent, or Firm* — Barnes & Thornburg LLP

(57) ABSTRACT

A gas turbine engine bladed component, such as a turbine blade, is shown as including a shroud located above a blade portion and a stiffener located above the shroud. The stiffener is generally located in a central interior region of the shroud and includes a raised portion that extends above a top surface of the shroud. In one non-limiting form the stiffener can have a central ridge that is oriented in an axial direction. Seal members can be included in the shroud that can be used to interact with corresponding seal members in static gas turbine engine structure to discourage a flow of fluid. In one form the shroud includes an upturned leading edge portion.

17 Claims, 4 Drawing Sheets

(52) U.S. Cl.
CPC .... *F05D 2240/307* (2013.01); *F05D 2240/55* (2013.01); *Y10T 29/49321* (2015.01); *Y10T 29/49337* (2015.01)

(58) Field of Classification Search
CPC ..... F05D 2240/125; F05D 2240/307; F05D 2240/80; F04D 29/181; F04D 29/32; F04D 29/321; F04D 29/325; F04D 29/326
See application file for complete search history.

(56) References Cited

U.S. PATENT DOCUMENTS

| | | | | |
|---|---|---|---|---|
| 4,326,836 | A | 4/1982 | Fitton | |
| 4,533,298 | A | 8/1985 | Partington et al. | |
| 4,710,102 | A | 12/1987 | Ortolano | |
| 4,948,338 | A | 8/1990 | Wickerson | |
| 5,007,800 | A * | 4/1991 | Hacault | F01D 5/225 416/191 |
| 5,083,903 | A | 1/1992 | Erdmann | |
| 5,211,540 | A | 5/1993 | Evans | |
| 5,971,710 | A * | 10/1999 | Stauffer | B23P 6/002 415/118 |
| 6,154,581 | A | 11/2000 | Lu et al. | |
| 6,241,471 | B1 | 6/2001 | Herron | |
| 6,371,725 | B1 * | 4/2002 | Manteiga | F01D 5/14 415/209.4 |
| 6,413,045 | B1 | 7/2002 | Dancer et al. | |
| 6,491,498 | B1 | 12/2002 | Seleski et al. | |
| 6,893,216 | B2 | 5/2005 | Snook et al. | |
| 6,913,445 | B1 | 7/2005 | Beddard et al. | |
| 7,001,152 | B2 | 2/2006 | Paquet et al. | |
| 7,063,509 | B2 | 6/2006 | Snook et al. | |
| 7,066,713 | B2 | 6/2006 | Dube et al. | |
| 7,094,023 | B2 | 8/2006 | Dube et al. | |
| 7,134,838 | B2 | 11/2006 | Dube et al. | |
| 7,396,205 | B2 | 7/2008 | Dube et al. | |
| 7,527,477 | B2 | 5/2009 | Norton et al. | |
| 7,628,587 | B2 | 12/2009 | McFeat et al. | |
| 7,722,329 | B2 * | 5/2010 | Clarke | F01D 5/141 416/223 R |
| 7,762,779 | B2 | 7/2010 | Zemitis et al. | |
| 7,887,925 | B2 | 2/2011 | Nooren | |
| 7,976,280 | B2 | 7/2011 | Brittingham et al. | |
| 8,152,454 | B2 * | 4/2012 | Khanin | F01D 9/041 415/135 |
| 8,192,166 | B2 * | 6/2012 | Beeck | F01D 5/225 415/173.6 |
| 8,322,986 | B2 * | 12/2012 | DeSander | F01D 5/187 416/96 R |
| 8,821,111 | B2 * | 9/2014 | Gear | F01D 5/187 415/115 |
| 9,045,992 | B2 * | 6/2015 | Roussille | B29C 70/24 |
| 9,103,218 | B2 * | 8/2015 | Pikul | F01D 5/225 |
| 9,322,281 | B2 * | 4/2016 | Schlemmer | F01D 5/225 |
| 9,464,529 | B2 * | 10/2016 | Zambetti | F01D 5/225 |
| 2012/0003078 | A1 | 1/2012 | Pikul et al. | |
| 2012/0070309 | A1 * | 3/2012 | Zambetti | F01D 5/225 416/97 R |
| 2012/0195766 | A1 | 8/2012 | Cohin et al. | |
| 2014/0154082 | A1 * | 6/2014 | Shinn | B23K 1/0018 416/191 |
| 2015/0017003 | A1 * | 1/2015 | Shaffer | F01D 5/225 416/182 |
| 2015/0369058 | A1 * | 12/2015 | Negri | F01D 5/225 416/241 R |
| 2016/0016227 | A1 * | 1/2016 | Klein | F01D 5/225 428/583 |
| 2016/0169052 | A1 * | 6/2016 | Balliel | F01D 25/32 416/96 R |

FOREIGN PATENT DOCUMENTS

| | | | | |
|---|---|---|---|---|
| GB | 2005775 A | * | 4/1979 | F01D 5/187 |
| GB | 1605335 A | | 12/1991 | |
| JP | 2005207294 A | * | 8/2005 | |

OTHER PUBLICATIONS

Fan Jiang et al., "Research on Design and Optimization of the Turbine Blade Shroud," 2nd International Conference on Engineering Optimization, Sep. 6-9, 2010, pp. 1-7.
Seleski, R., "Gas Turbine Efficiency Improvements Through Shroud Modifications," Power Systems Mfg., LLC, pp. 1-12.
DeBeer, B., "VECTRA Power Turbine Design and Development," Dresser-Rand, Olean, N.Y., pp. 1-8.
Reed, Roger C., "The Superalloys: Fundamentals and Applications," Cambridge Press, 2006, pp. 1-50.

* cited by examiner

GAS TURBINE ENGINE SHROUDED BLADE

CROSS REFERENCE TO RELATED APPLICATIONS

This application claims priority to and the benefit of U.S. Provisional Patent Application No. 61/774,138, filed Mar. 7, 2013, the disclosure of which is now expressly incorporated herein by reference.

TECHNICAL FIELD

The present invention generally relates to gas turbine engine shrouded blades, and more particularly, but not exclusively, to stiffeners used with gas turbine engine shrouded blades.

BACKGROUND

Providing gas turbine engine shrouded blades with acceptable levels of structural properties, such as but not limited to the ability to withstand imposed centrifugal loads, remains an area of interest. Some existing systems have various shortcomings relative to certain applications. Accordingly, there remains a need for further contributions in this area of technology

SUMMARY

One embodiment of the present invention is a unique gas turbine engine shrouded blade. Other embodiments include apparatuses, systems, devices, hardware, methods, and combinations for reducing stresses and edge creep curl of gas turbine engine shrouded blades. Further embodiments, forms, features, aspects, benefits, and advantages of the present application shall become apparent from the description and figures provided herewith.

BRIEF DESCRIPTIONS OF THE FIGURES

The detailed description particularly refers to the accompanying figures in which.

DETAILED DESCRIPTION

Figure 1:
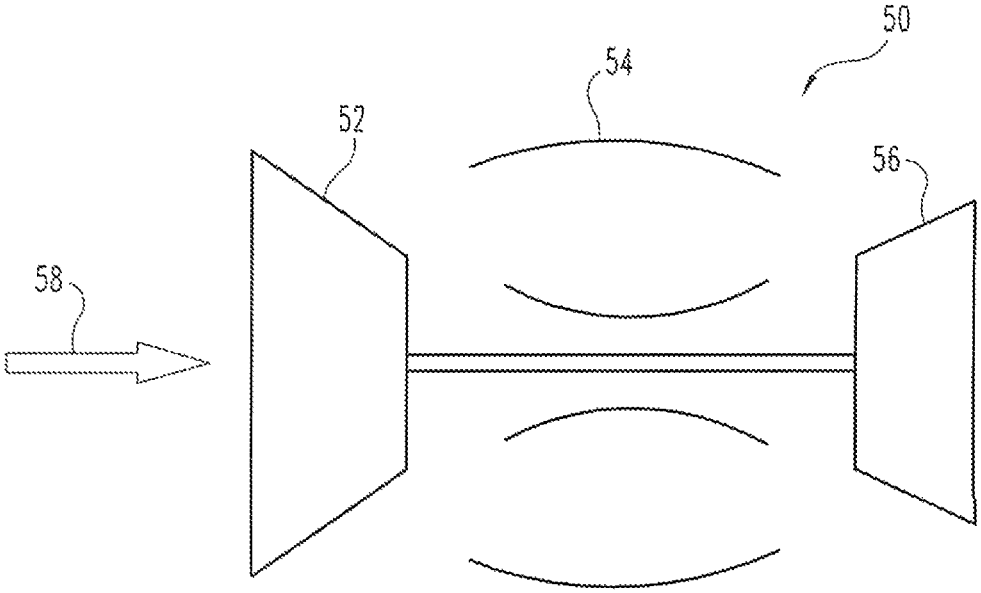
FIG. 1 depicts one embodiment of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, one embodiment of a gas turbine engine 50 is disclosed which is capable of producing power for an aircraft. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles. Further, the present inventions are contemplated for utilization in other applications that may not be coupled with an aircraft such as, for example, industrial applications, power generation, pumping sets, naval propulsion, weapon systems, security systems, perimeter defense security systems, and the like known to one of ordinary skill in the art.

The gas turbine engine 50 includes a compressor 52, combustor 54, and a turbine 56 which together work in concert to produce power. A flow of working fluid 58 is received into the compressor 52 which is used to compress the working fluid 58 and provided to the combustor 54. The working fluid 58 can be air as would be typical for most gas turbine engines. Fuel is injected in the combustor 54 after which it is mixed with the compressed working fluid 58 and thereafter combusted in the combustor 54. Products of combustion from the combustion process as well as working fluid 58 not used in the combustion process are provided to the turbine 56 which is used to extract work from the mixture to drive various accessories. For example, work extracted from the turbine 56 can be used to drive the compressor 52.

Though the gas turbine engine 50 is depicted in the illustrated embodiment in a turbojet form, the gas turbine engine 50 can take other forms such as a turboshaft, turbofan, or turboprop. Furthermore, the gas turbine engine 50 can be an variable and/or adaptive cycle engine.

Figure 2:
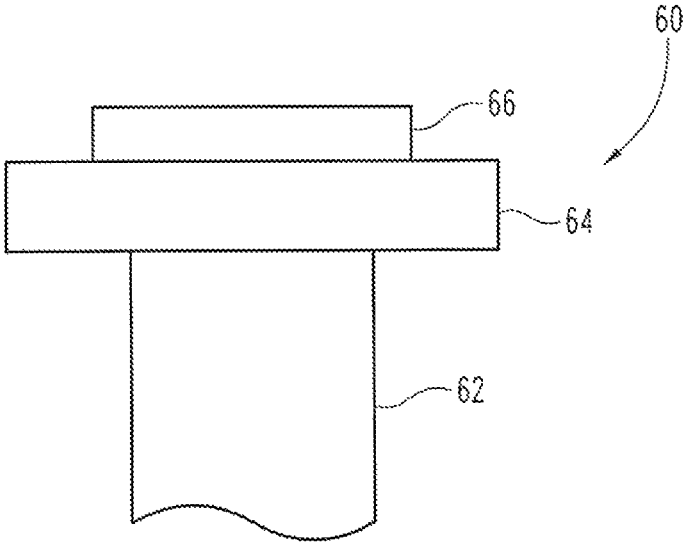
FIG. 2 depicts an embodiment of a turbomachinery bladed component.

Turning now to FIG. 2, one embodiment of a turbomachinery bladed component 60 is depicted and includes a working blade 62, shroud 64, and a stiffener 66. As will be described further below, the stiffener 66 can be used to control mass and stiffness thus reducing centrifugal (CF) loading imparted during operation of the bladed component 60. In general, the shroud 64 provides fluid flow separation of a sort between the working blade 62 and the stiffener 66 such that the working blade 62 is substantially exposed to a flow of working fluid when it is in operation, and correspondingly changes a pressure of the working fluid as a result of that operation, while the stiffener 66 is substantially shielded from working fluid such that it has little to no impact on a pressure of working fluid that is used in the thermodynamic cycle of the gas turbine engine 50. The shroud 64 and/or stiffener 66 can take a variety of forms as will be shown in various embodiments described and illustrated further below. Unless otherwise stated to the contrary, no limitation is intended regarding the geometry and relative dimensions of either of the shroud 64 and/or the stiffener 66.

Figure 3:
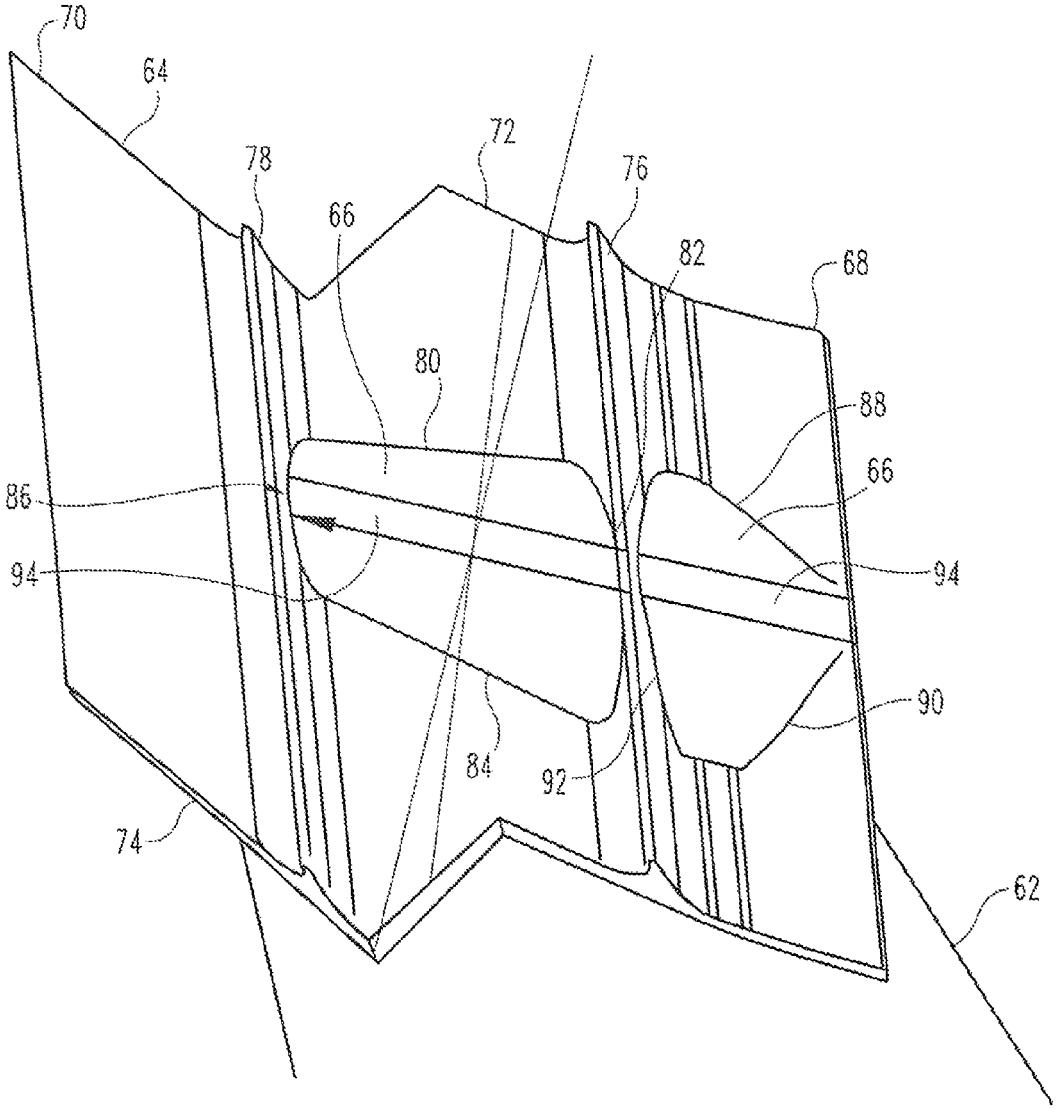
FIG. 3 depicts one view of a turbomachinery bladed component.
Figure 4:
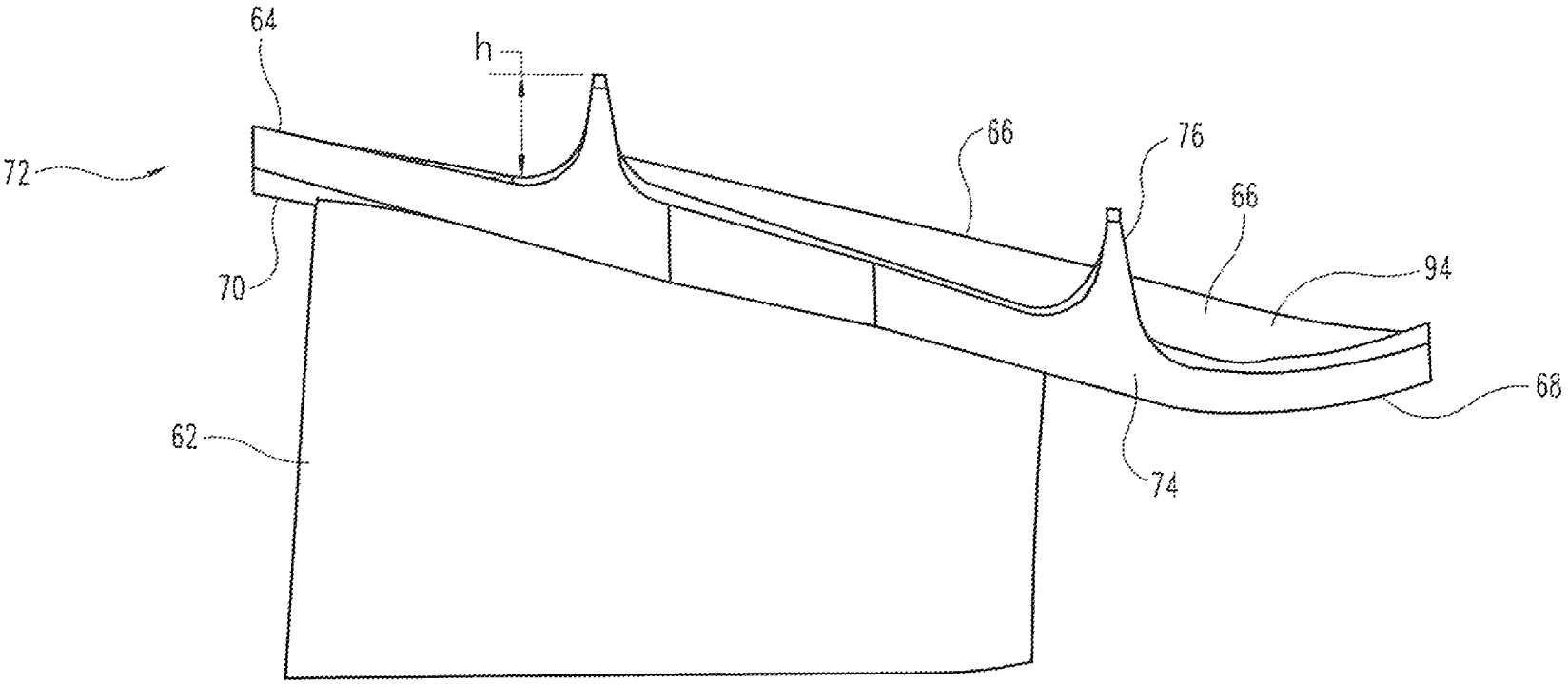
FIG. 4 depicts one view of a turbomachinery bladed component.
Figure 5:
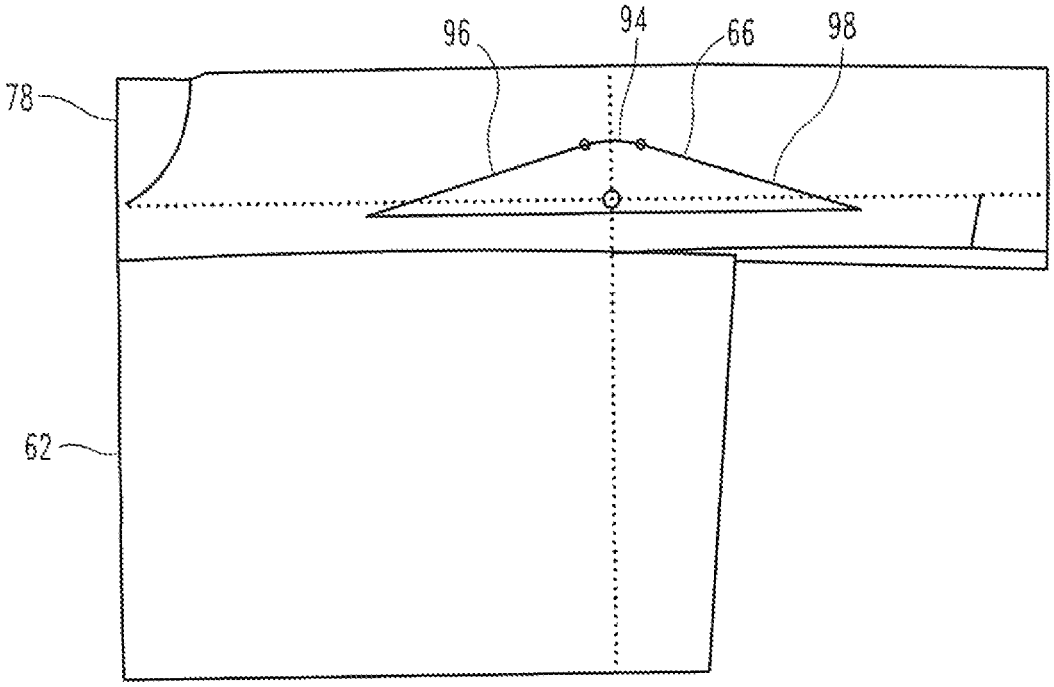
FIG. 5 depicts one view of a turbomachinery bladed component.

Turning now to FIGS. 3, 4, and 5, various views are depicted of the turbomachinery bladed component 60 having the working blade 62, shroud 64, and one or more stiffeners 66. The working blade 62 includes a pressure side and a suction side as will be appreciated by those in the art familiar with the workings of a gas turbine engine bladed component. The working blade 62 extends along its span from an inner flow path portion to the shroud 64. The working blade 62 can be a separate blade that is attached to a rotor wheel of the gas turbine engine 50, but no limitation is hereby intended regarding the type of attachment or the manner of construction of either the working blade 62 and/or the wheel/disk/rotor of the gas turbine engine 50.

As will be appreciated given the views and FIGS. 3 and 4, the shroud 64 generally extends between a leading edge portion 68 and a trailing edge portion 70 in the axial direction, as well as between side portions 72 and 74 in the circumferential direction. The shroud 64 is depicted as a z-form interlocking shroud in the illustrated embodiment which can be coupled with a complementary formed interlocking shroud formed in an adjacent turbomachinery bladed component 60. As will be appreciated given the depiction in the figures, when adjacent turbomachinery bladed components 60 are coupled together, the shrouds 64 form a flow path surface having a leading edge portion 68 that generally extends in a circumferential straight line as well as a trailing edge portion 70 that generally extends circumferential straight line. Though the shroud 64 is depicted as a z-form interlocking shroud, the shroud 64 can take on a variety of other shapes in different embodiments. Whether or not the shroud 64 is in the form of a z-form interlocking shroud in any given embodiment, it will be appreciated that the leading edge portion 68 and trailing edge portion 70 can remain as straight lines.

The shroud 64 is also depicted in the illustrated embodiment as including a forward seal member 76 and an aft seal member 78 that are used in conjunction with static structure in the gas turbine engine 50 useful in forming a sealed to discourage the flow of working fluid in the non-flow side of the shroud 64. The seals 76 and 78 generally extend in a radial direction as well as extend the full extent between the side portion 72 and side portion 74. Other embodiments, however, may include seal members that extend only partially between the side portion 72 and side portion 74. The seal members 76 and 78 can extend a similar height h away from a reference elevation of the shroud 64 (such as the non-flow path top surface of the shroud 64), wherein the similar height h can be a height on the forward or aft portion of the seal member 76 or 78. Furthermore, the seal members 76 and 78 can take a variety of other forms other than those depicted in the illustrated embodiment. As used herein, relational terms such as "top", "bottom", "left", and "right", among others, are used for reference of convenience only and are not intended to be limiting in any given embodiment.

The stiffener 66 of the illustrated embodiment includes a portion between forward seal member 76 and aft seal member 78, as well as a portion forward of forward seal member 76. Some embodiments of the turbomachinery bladed component 60 may only include one or the other of the stiffener 66 portions depicted in FIG. 3. For example, in some non-limiting embodiments the turbomachinery bladed component 60 may only include the stiffener 66 located between the forward seal member 76 and aft seal member 78.

The stiffener 66 in the illustrated embodiment is located between the forward seal member 76 and the aft seal member 78 is approximately quadrilateral shape. As used herein, when the stiffener 66 is described as having an approximately quadrilateral shape what is intended to be conveyed is that in the context of the instant application the approximate quadrilateral shape includes a periphery of the stiffener 66 that roughly defines four opposing sides of the quadrilateral shape, whether or not those opposing sides are linear in shape or not. Thus, when the phrase approximate quadrilateral shape is used, that phrase is broad enough to include not only shapes that have straight edges but that also include shapes that have curved sides as well as curved transitions between sites.

For example, though the sides 80 and 84 are depicted as straight lines, sides 82 and 86 include a prominently curved portion at least as seen in the view depicted in FIG. 3. It should be noted, however, that the curved nature of sides 82 and 86 as depicted in FIG. 3 are due in part to the intersection of the stiffener 66 with upturned portions associated with either of the forward seal member 76 or aft seal member 78. Thus, whether or not the sides 82 and 86 are in fact curved will depend in part upon the intersection of the stiffener 66 with a surface of the turbomachinery bladed component 60 as well as whether the drawing that depicts the turbomachinery bladed component 60 is a top view, a side view, a perspective view, etc. The transition between any of the adjacent sides 80, 82, 84, and 86, are curved in nature but not all embodiments need include curved transitions. Not all embodiments of the stiffener 66 need take the approximate quadrilateral shape as depicted in FIG. 3. Other shapes are also contemplated.

The stiffener 66 located forward of the forward seal member 76 is depicted as having an approximate triangular shape, but not all embodiments of the stiffener 66 located forward of the forward seal member 76 need include such a shape. As used herein, when the stiffener 66 is described as having an approximately triangular shape what is intended to be conveyed is that in the context of the instant application the approximate triangular shape includes a periphery of the stiffener 66 that roughly defines three opposing sides of the triangular shape, whether or not those opposing sides are linear in shape or not. Thus, when the phrase approximate triangular shape is used, that phrase is broad enough to include not only shapes that have straight edges but that also include shapes that have curved sides as well as curved transitions between sites.

For example, though the sides 80 and 90 are depicted as straight lines, side 92 includes a prominently curved portion at least as seen in the view depicted in FIG. 3. It should be noted, however, that the curved nature of side 92 as depicted in FIG. 3 is due in part to the intersection of the stiffener 66 with upturned portions associated with the forward seal member 76. Thus, whether or not the side 92 is in fact curved will depend in part upon the intersection of the stiffener 66 with a surface of the turbomachinery bladed component 60 as well as whether the drawing that depicts the turbomachinery bladed component 60 is a top view, a side view, a perspective view, etc. The transition between any of the adjacent sides 88, 90, and 92, are curved in nature but not all embodiments need include curved transitions. Not all embodiments of the stiffener 66 forward of the forward seal member 76 need take the approximate triangular shape as depicted in FIG. 3. Other shapes are also contemplated.

The stiffener 66 can take on any variety of shapes that can be approximate forms of recognized geometric shapes such as triangles, quadrilaterals, etc. but not all forms of the stiffener 66 need take on approximate geometric shapes. As will be described further below, the outer periphery of the stiffener 66 can be used to determine the approximate shape of the stiffener 66, but a precise categorization of the stiffener 66 is not needed in every given embodiment of the stiffener 66.

The stiffener 66 of the illustrated embodiment includes a central ridge 94 that extends from an aft portion of the stiffener 66 to afford portion of the stiffener 66. The stiffener 66 includes surfaces 96 and 98 that slope away on either side of the central ridge 94. These surfaces 96 and 98 can slope away at a constant linear rate, but not all forms of surfaces 96 and 98 need slope away at a constant rate. Furthermore, though the surfaces 96 and 98 are shown as being symmetric on either side of the central ridge 94, it will be appreciated that in some embodiments of the turbomachinery bladed component 60 the surfaces 96 and 98 can be different. For example, the surface 96 can slip away at a different rate than the surfaces 98. Other non-limiting examples include surfaces 96 or 98 that are curved in nature, piecewise linear, or a combination of curved and linear segments, among other various possibilities. These surfaces included in the stiffener 66 forward of the forward seal member 76 can also include any the variations of the surfaces 96 and 98 described above with respect to the stiffener 66 located between the forward seal member 76 and aft seal member 78.

The central ridge 94 in the illustrated embodiment is oriented along the chord line of the working blade 62, but not all embodiments of the central ridge 94 need be oriented along the chord line. In some embodiments the central ridge 94 may mimic a contour of the working blade 62. In other embodiments, the central ridge 94 departs from the contours of the working blade 62. For example, the central ridge 94 can fall along a strictly axial line as it would be determined when the turbomachinery bladed component 60 is mounted in a gas turbine engine 50. Furthermore, the central ridge 94 need not strictly be limited to a shape that falls along a straight line. In some embodiments the central ridge 94 can be curved in nature, piecewise linear, or a combination of curved and linear segments, among any variety of other possibilities.

Though the embodiment depicted in FIG. 3 depicts a single central ridge 94, in some embodiments the stiffener 66 can include multiple ridges and/or peaks that are distributed around the stiffener 66. In general, the ridges and/or peaks if present will be concentrated in a central portion of the shroud 64 in keeping with the embodiment pictured in FIG. 3 in which the contours of the stiffener 66 are shown located in the central region of the shroud 64.

The central ridge 94 in the illustrated embodiment can be considered a global maximum in elevation relative to a top surface of the shroud 64 (which conveniently serves as a line of reference for the discussion herein), but the stiffener 66 can also include features that provide several local maximums. For example, the stiffener 66 can include multiple peaks or ridges. Such peaks and/or ridges can be distributed circumferentially, axially, or a combination thereof. Furthermore, the ridges can extend along a generally straight line but other paths are also contemplated herein. No matter the form of the local maximums present in the stiffener 66, it will be appreciated that the raised central portion associated with the central ridge 94, additional ridge(s), or peak(s), descends to a relatively low elevation at bath the first circumferential side and the second circumferential side.

Although the top surface of the shroud 64 can serve as a useful line of reference for a discussion regarding the relative elevation of any given portion of the stiffener 66, and other lines of reference can also be used. For example, in some situations the elevation of any given portion of the stiffener 66 can be measured relative to elevation of other arbitrary curved reference points whether or not those arbitrary curved reference points are located within the shroud 64 or outside of the shroud 64. In this way, the elevation of any given portion of the stiffener 66 can be measured similar to techniques used to measure elevation of geographic points relative to the curvature of the earth. Such lines of reference are merely used for convenience of discussion and in many situations the relative elevation of any given portion of the stiffener 66 will be context specific. To continue using the curvature of the earth as an example, the earth is in some applications modeled as an oblate spheroid as opposed to a perfect sphere and the application of a gravity field will result in discrepancies between an elevation measured relative to the oblate spheroid and an elevation measured relative to a mean sea level. Be that as it may, "elevation" as used in the instant application can be measured from an arc of constant curvature, it can represent a height above a datum, or it can represent a height above a surface such as the top surface of the shroud 64, among other possibilities.

The outer periphery of the stiffener 66 has been alluded to in the discussion above relative to the shape of the stiffener 66. In that context of elevation discussed above, the outer periphery of the stiffener 66 can be defined as the intersection between the relatively elevated portions of the stiffener 66 and the line of reference, such as the top surface of the shroud 64. Therefore, similar to elevation maps used when navigating wilderness areas, the outer periphery can be denoted by an imaginary line that represents the lower extent of the raised portion. The outer periphery of the stiffener 66 is nominally confined to the interior area of the shroud well away from the edge, but in some embodiments the outer periphery can extend to an edge of the shroud. For example, the stiffener 66 located forward of the forward seal member 76 can extend to the leading edge portion 68 of the shroud 64. In other alternative and/or additional embodiments, the raised portion can extend over an edge of the shroud.

Turning specifically to the view depicted in FIG. 4, a side view of the stiffener 66 and the side portion 72 is depicted. As can be seen in the illustration, the central ridge 94 extends in a relatively straight line in the portion of the stiffener 66 located between the forward seal member 76 and the aft seal member 78 as well as the stiffener portion 66 located forward of the forward seal member 76. Not all embodiments of the central ridge 94 need include ridges that fall along a straight line. For example, the central ridge 94 can include curved shapes, piecewise linear shapes, or a combination of cured and linear segments, among other variations. Also shown in FIG. 4, the central ridge 94 of both portions of the stiffener 66 fall along a common line. Not all embodiments need be arranged according to the depiction in FIG. 4. For example, the central ridge 94 of the stiffener 66 located between the forward seal member 76 and aft seal member 78 can have a shape/orientation/configuration/etc. different than the central ridge 94 of the stiffener 66 located forward of the forward seal member 76.

The shroud 64 can include any number of other characteristics whether depicted or not and illustrative embodiments. In one non-limiting form the shroud 64 does not include trimmed or scalloped edges. In the illustrated form depicted in FIG. 4, the leading edge portion 68 of the shroud 64 is in an upturned, or curled, configuration sometimes referred to as a ski jump and can be used to assist in controlling edge creep curl. The curled nature of the leading edge portion 68 of the illustrated embodiment begins around the forward seal member 76, but other embodiments of the leading edge portion 68 can begin to be curled or upturned at other locations. Furthermore, not all embodiments of the shroud 64 need include an upturned leading edge portion 68.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an" "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings in some forms can refer to components that are entered poorly manufactured, such as through a casting, bonding, or analogous operation.

What is claimed is:

1. An apparatus comprising:

a gas turbine engine turbine blade;

a tip shroud attached to the gas turbine engine blade; and means for stiffening the turbine blade, wherein the tip shroud further includes means for reducing edge creep curl, wherein the gas turbine engine blade has a pressure side and a suction side that extend along a span to a radially outer portion of the gas turbine engine blade; and the tip shroud is connected with the radially outer portion of the gas turbine engine blade and extends beyond the gas turbine engine blade in a first direction to a first circumferential side and in a second direction to a second circumferential side, the tip shroud having a flow path side, a non-flow path side, and forward and aft seal extensions that protrude radially outward from the tip shroud; and wherein the means for stiffening the turbine blade includes a thickened stiffener placed in a central portion of the non-flow path side of the tip shroud, the thickened stiffener being raised in elevation from the non-flow path side relative to an elevation of the first circumferential side and the second circumferential side, the thickened stiffener descending to an outer periphery that extends circumferentially short of both the first circumferential side and the second circumferential side, and the outer periphery extends to a leading edge of the tip shroud.

2. An apparatus comprising:

a gas turbine engine blade having a pressure side and a suction side that extend along a span to a radially outer portion; and a shroud connected with the radially outer portion of the gas turbine engine blade and extending beyond the gas turbine engine blade in a first direction to a first circumferential side and in a second direction to a second circumferential side, the shroud having a flow path side and a non-flow path side, the non-flow path side including a thickened stiffener placed in a central portion of the shroud and raised in elevation from the non-flow path side relative to an elevation of the first circumferential side and the second circumferential side, the thickened stiffener descending to an outer periphery that extends circumferentially short of both the first circumferential side and the second circumferential side, wherein the shroud includes a forward seal extension that protrudes radially outward from the shroud, and wherein the shroud includes an aft seal extension and wherein the outer periphery extends to a leading edge of the shroud, wherein the thickened stiffener resides axially between the seal extensions, and wherein the thickened stiffener includes a central ridge that grows in elevation as it extends forward from the aft seal extension to the forward seal extension.

3. The apparatus of claim 2, wherein the shroud is a z-form shroud structured to interlock with neighboring gas turbine engine blades having a complementary z-form shroud.

4. The apparatus of claim 2, wherein the leading edge is formed as an up-turned ski jump, and wherein each of the forward seal extension and aft seal extension extends circumferentially to an edge of the shroud, and wherein the leading edge is straight.

5. The apparatus of claim 2, wherein the thickened stiffener further resides in a location between the forward seal extension and the leading edge of the shroud, and wherein the first circumferential side and the second circumferential side have corresponding thicknesses.

6. The apparatus of claim 2, wherein over substantially an entire axial length of the thickened stiffener between the forward seal extension and aft seal extension the descending of the thickened stiffener is defined by a surface of the non-flow path side of the shroud that descends from a peak of the thickened stiffener towards the first circumferential side and towards the second circumferential side.

7. An apparatus comprising:

an axial flow turbomachinery blade structured for operation in a gas turbine engine and to rotate at high speeds about an axis of rotation, the axial flow turbomachinery blade having a shroud disposed at a radial outer end, the shroud having axially forward and axially aft edges and extends between a first lateral side and a second lateral side, the shroud also including a central stiffener on a side of the shroud opposite the axial flow turbomachinery blade and substantially shielded from exchanging work with a fluid, the central stiffener disposed circumferentially inward of the first and second lateral sides and characterized by an upper portion that sits at a higher elevation than a first lateral side surface and a second lateral side surface of the central stiffener, and wherein the shroud includes radially extending forward and aft seal extensions, a first portion of the central stiffener extends between and interconnects the forward and aft seal extensions, and wherein the central stiffener includes a maximum peak from which the first lateral side surface and the second lateral side surface descend toward the first and second lateral sides.

8. The apparatus of claim 7, wherein the first lateral side of the shroud is z-form shaped and constructed to be interconnected with a second lateral side of a neighboring blade when installed in a gas turbine engine.

9. The apparatus of claim 8, wherein the axially forward edge of the shroud includes a ski-jump portion.

10. The apparatus of claim 8, wherein the axial flow turbomachinery blade does not extend beyond the axially forward edge, axially aft edge, first lateral side, and second lateral side of the shroud.

11. The apparatus of claim 10, wherein a second portion of the central stiffener extends forward of the forward seal extension.

12. The apparatus of claim 7, wherein the first portion of the central stiffener is approximately quadrilateral in shape, and wherein the axially forward edge of the shroud is linear.

13. The apparatus of claim 12, wherein a second portion of the central stiffener extends forward of the forward seal extension, the second portion of the central stiffener is approximately triangular in shape, and the second portion of the central stiffener extends to the axially forward edge.

14. The apparatus of claim 7, wherein a second portion of the central stiffener extends forward of the forward seal extension and the second portion of the central stiffener is approximately triangular in shape.

15. The apparatus of claim 14, wherein the second portion of the central stiffener extends to the axially forward edge.

16. A method comprising:

forming a gas turbine engine blade having a pressure side and a suction side that extend along a span to a radially outer portion; and connecting together the radially outer portion and a shroud, wherein the shroud extends beyond the gas turbine engine blade in a first direction to a first circumferential side and in a second direction to a second circumferential side, the shroud having a flow path side and a non-flow path side, the non-flow path side including a thickened stiffener placed in a central portion of the shroud and raised in elevation from the non-flow path side relative to an elevation of the first circumferential side and the second circumferential side, the thickened stiffener descending to an outer periphery that extends circumferentially short of both the first circumferential side and the second circumferential side, wherein the shroud includes a forward seal extension and an aft seal extension that protrude radially outward from the shroud, and wherein the outer periphery extends to an axially forward edge of the shroud, wherein the shroud has an axially aft edge and the axially forward edge includes a ski-jump portion.

17. The method of claim 16, wherein the thickened stiffener resides axially between the seal extensions and wherein the thickened stiffener includes a central ridge that grows in elevation as it extends forward from the aft seal extension to the forward seal extension.

* * * * *